US008220161B2

(12) United States Patent
Chang

(10) Patent No.: US 8,220,161 B2
(45) Date of Patent: Jul. 17, 2012

(54) MULTI-FUNCTION CUTTER

(76) Inventor: Chih-Wei Chang, Taichung County (TW)

( * ) Notice: Subject to any disclaimer, the term of this patent is extended or adjusted under 35 U.S.C. 154(b) by 202 days.

(21) Appl. No.: 12/804,798

(22) Filed: Jul. 28, 2010

(65) Prior Publication Data

US 2012/0023754 A1 Feb. 2, 2012

(51) Int. Cl.
*B26B 1/08* (2006.01)

(52) U.S. Cl. ..... 30/162; 30/125; 30/335

(58) Field of Classification Search ..... 30/125, 30/162, 335
See application file for complete search history.

(56) References Cited

U.S. PATENT DOCUMENTS

| | | | | |
|---|---|---|---|---|
| 3,192,624 | A * | 7/1965 | Gringer | 30/162 |
| 3,577,637 | A * | 5/1971 | Braginetz | 30/162 |
| 6,192,589 | B1 * | 2/2001 | Martone et al. | 30/125 |
| 6,513,246 | B2 * | 2/2003 | Ping | 30/125 |
| 6,553,674 | B1 * | 4/2003 | Budrow | 30/162 |
| 6,829,827 | B2 * | 12/2004 | Tseng | 30/162 |
| 6,886,257 | B2 * | 5/2005 | Chih | 30/125 |
| 7,121,006 | B2 * | 10/2006 | Sun | 30/162 |
| 7,448,136 | B2 * | 11/2008 | Huang | 30/125 |
| 7,987,602 | B2 * | 8/2011 | Kanemoto et al. | 30/162 |
| 8,001,641 | B1 * | 8/2011 | Williams | 7/163 |
| 2004/0040159 | A1 * | 3/2004 | Fossella | 30/162 |
| 2005/0028390 | A1 * | 2/2005 | Legrand | 30/347 |
| 2005/0193567 | A1 * | 9/2005 | Ho | 30/162 |
| 2006/0242841 | A1 * | 11/2006 | Fossella | 30/162 |

* cited by examiner

*Primary Examiner* — Hwei C Payer
(74) *Attorney, Agent, or Firm* — Charles E. Baxley

(57) ABSTRACT

A multi-function cutter includes a body composed of a first half and a second half, wherein the first and second halves are formed with indentations, concave portions, guides parallel to the concave portions and rows of positioning pits arranged along the concave portions; a blade holder sliding along the guides to jut out of the indentation and having a spring socket; and an adjusting device deposited in the spring socket and exposing outside the concave portions. Therein, an adjusting spring is arranged between the adjusting device and the spring socket, and the adjusting device is bilaterally formed with wedge portions for detachably engaging the corresponding positioning pits, so as to stretch the blade holder in multiple stages.

9 Claims, 8 Drawing Sheets

MULTI-FUNCTION CUTTER

BACKGROUND OF THE INVENTION

1. Technical Field

The present invention relates to cutters, and more particularly, to a multi-function cutter that allows multi-stage adjustment of blade length, replacement of blades and storage of blades.

2. Description of Related Art

In industrial practice and people daily life, utility knifes are popular and essential. A conventional utility knife typically has its body mounted with a sliding adjuster where a blade is fixed, so that when the sliding adjuster is operated, the blade juts out of or retracts into the body. In addition, on the body, there is a row of sawteeth arranged along the sliding direction of the sliding adjuster for a retaining portion of the sliding adjuster to detachably couple. Thereby, the length of the blade exposed outside the body can be adjusted for meeting cutting needs, and then the blade can be positioned with the retaining portion wedged between two positionally-corresponding adjacent sawteeth.

For cutting wood or something rigid, the exposed length of the blade is preferably short in order to facilitate exerting force and to prevent the blade from breaking. However, since the adjuster itself is raised from the body and tends to be activated when held in a user's palm, the adjuster may be unintentionally slid to stretch out or retract the blade due to excessively exerted cutting force. This results in either interruption of cutting or broken blade, and the latter can even cause physical danger to the user.

On the other hand, the point of the blade can be blunted after a long term of use. Therefore, the body is tailed with a detachable blade-breaking device, which, when detached from the body, can be used to break a blunted section of the blade that is of an integrated multi-section structure, so as to re-sharpen the blade for further use. However, the operation of breaking the blade with the blade-breaking device is somehow inconvenient and dangerous. Moreover, since the blade is attached to the adjuster, it can not be replaced until many components are detached from the body. Besides, the body lacks for a storage space so spare blades have to be separately stored. These cause replacement of the blade inconvenient and time-consuming.

SUMMARY OF THE INVENTION

In view of the shortcomings of the prior art, the present invention herein provides a multi-function cutter.

The multi-function cutter of the present invention comprises: a body composed of a first half and a second half that are abreast combined, wherein each of the first half and the second half has an end edge formed with an indentation, an upper edge formed with a concave portion, a guide provided below the concave portion, and a row of positioning pits arranged along the concave portion; a blade holder including a blade socket for receiving a blade and being bilaterally formed with engaging portions for slidably coupled with the guides so as to stretch the blade holder outside the indentation, and having a spring socket; and an adjusting device being deposited in the spring socket and jutting out of the concave portions, wherein an adjusting spring is arranged between the adjusting device and the spring socket, and the adjusting device is bilaterally formed with wedge portions for detachably engaging corresponding said positioning pits, whereby, when the adjusting device is pressed downward, the adjusting spring is compressed to allow the wedge portions to depart from the positioning pits and the engaging portions are allowed to slide along the guides, and afterward, the adjusting spring that normally pushes the adjusting device makes the wedge portions engage the corresponding positioning pits, so as to allow the blade holder to stretch in multiple stages.

One objective of the present invention is to provide the above-described multi-function cutter, wherein in virtue of the adjusting device and the adjusting spring, as well as the positioning pits, the blade holder can be stretch in multiple stages. Also, it is impossible to shift the blade holder between the stages unless the adjusting device is pressed downward, thereby ensuring use safety. In other words, the adjusting device is prevented from unintentionally activated by excessively exerted cutting force so the blade holder is secured from accidentally stretching or retracting.

Another objective of the present invention is to provide the above-described multi-function cutter, wherein a pivotable spare container in the body serves to store at least one spare blade for facilitating replacement of the blade. Also, the pivotable spare container has one lower corner near a receiving seat pivotally fixed to the body and an engaging notch at a lower part of its lateral. A stopper is provided in the body for matching the engaging notch, the stopper has therein a stop spring. The cooperation therebetween allows the pivotable spare container to pivotally move inward or outward between the storage position and the access position.

Another objective of the present invention is to provide the above-described multi-function cutter, wherein the blade is formed with at least one dent arranged along a sliding direction of the blade holder and a retaining notch is extended upward from the blade socket, while a positioning member in the blade socket is configured to match the dent and the retaining notch and a positioning spring is arranged between the positioning member and the retaining notch, so that the cooperation therebetween allows the blade to slide and be positioned along the blade socket.

Another objective of the present invention is to provide the above-described multi-function cutter, wherein for allowing the blade to be installed reversely, there are preferably two said dents. When the point of the blade is blunted, the blade can be drawn out and reinstalled reversely for providing a new point.

Another objective, of the present invention is to provide the above-described multi-function cutter, which allows multi-stage adjustment of blade length, replacement of blades and storage of blades; thus proving improved convenience and utility.

Still another objective of the present invention is to provide the above-described multi-function cutter, wherein the blade has an outer end mounted with a shield so that a point of the blade is shielded from direct exposure, thereby ensuring safe use.

Yet another objective of the present invention is to provide the above-described multi-function cutter, wherein the body is composed of the first half and the second half so that all components can be received in the body and the multi-function cutter is of a one-piece structure that easy to hold and exert a force therethrough.

BRIEF DESCRIPTION OF THE DRAWINGS

The invention as well as a preferred mode of use, further objectives and advantages thereof will be best understood by reference to the following detailed description of an illustrative embodiment when read in conjunction with the accompanying drawings, wherein.

DETAILED DESCRIPTION OF THE INVENTION

Figure 1:
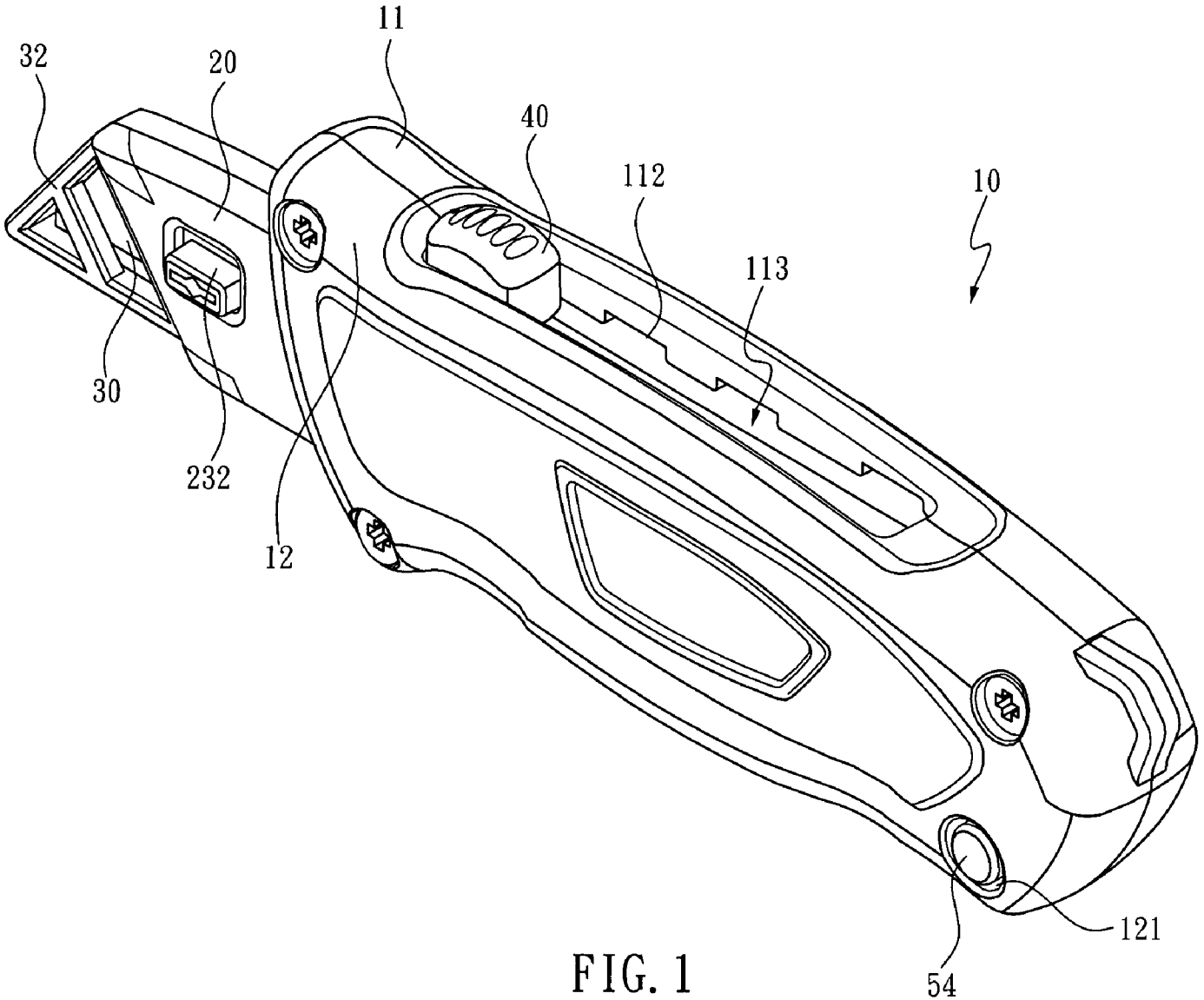
FIG. 1 is a perspective view of a multi-function cutter of the present invention.
Figure 2:
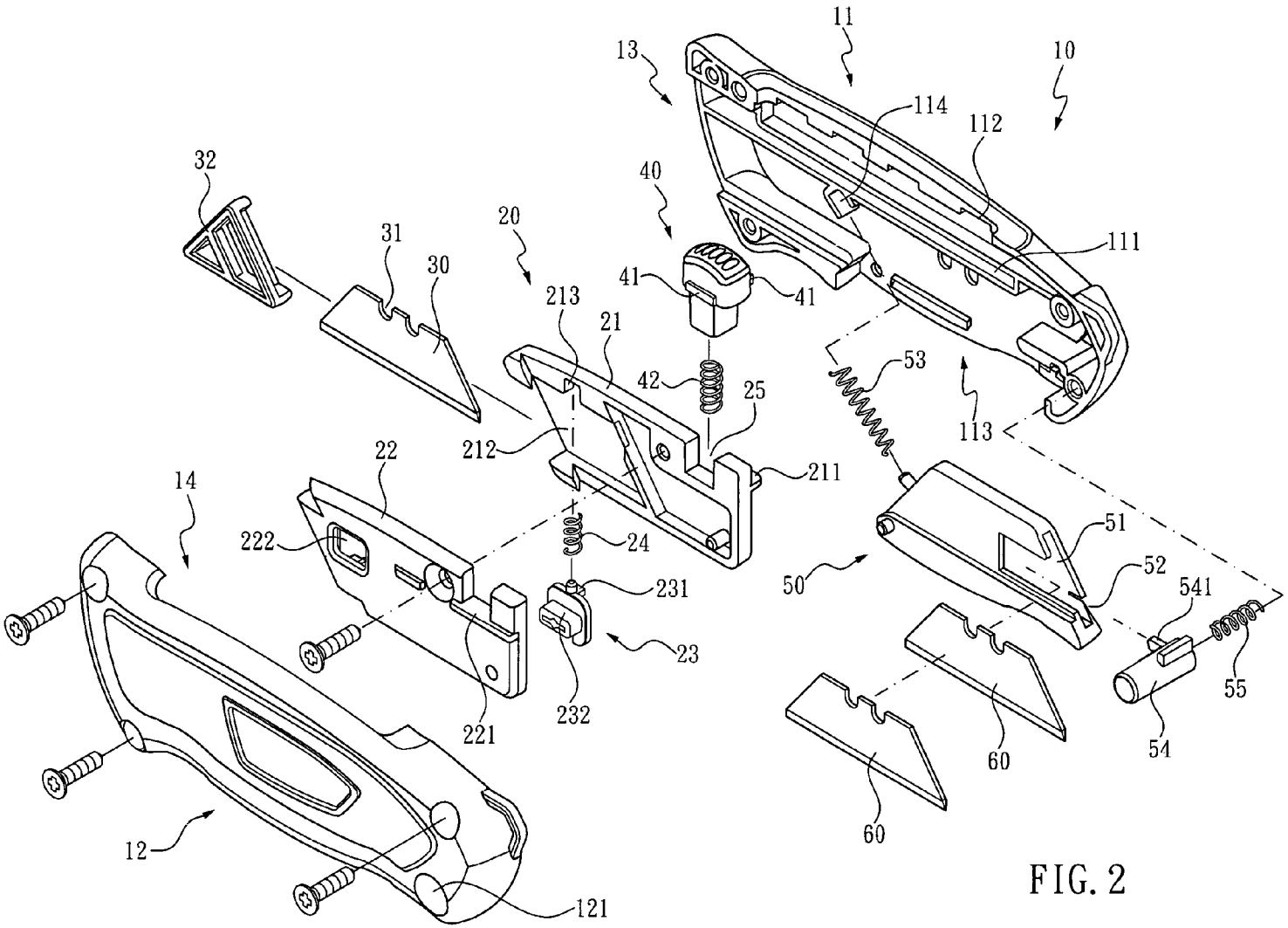
FIG. 2 is an exploded view of the multi-function cutter of the present invention.
Figure 3:
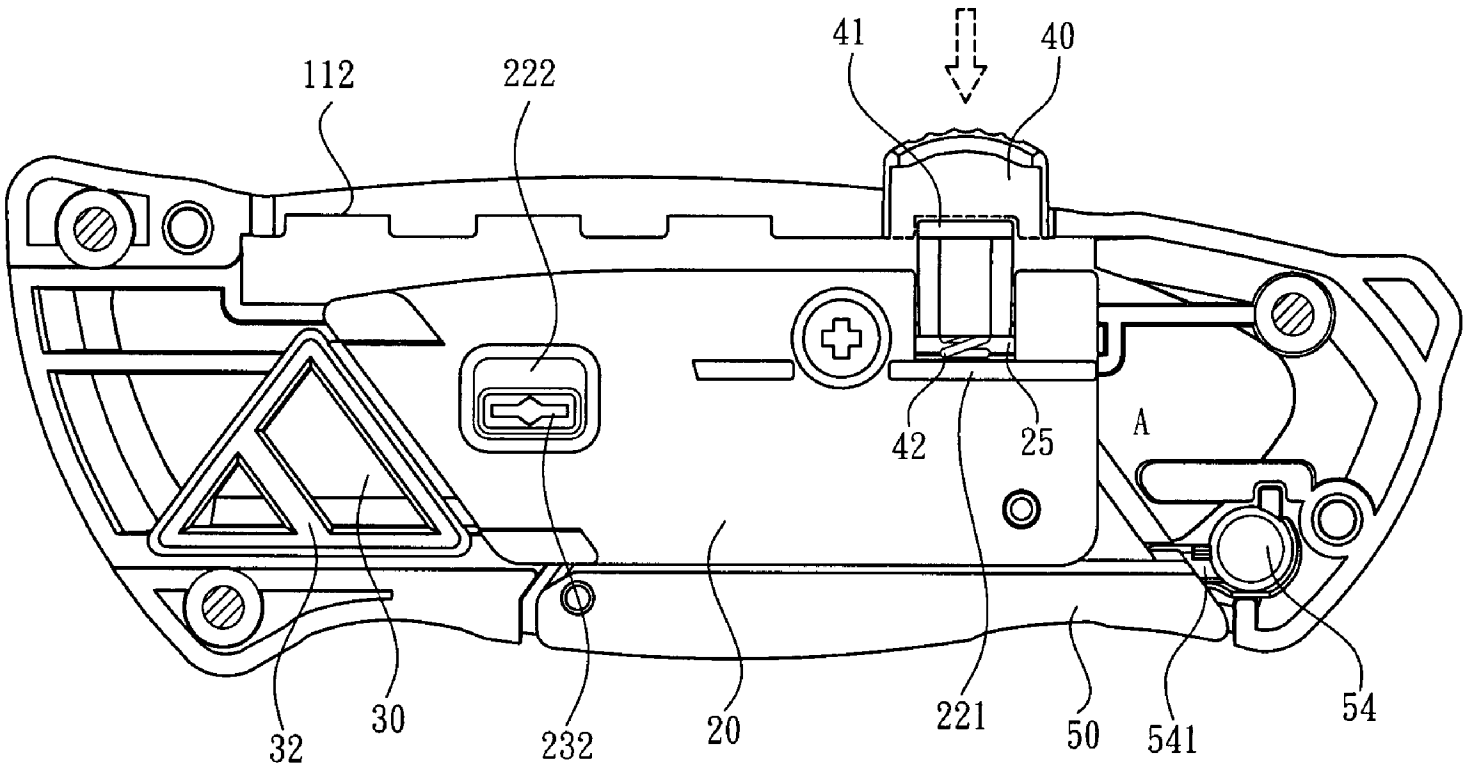
FIG. 3 is a partial, front view of the multi-function cutter of the present invention.

Referring to FIG. 1 through FIG. 3, the present invention is directed to a multi-function cutter, which primarily comprises a body 10, a blade holder 20, a blade 30, an adjusting device 40, a pivotable spare container 50 and at least one spare blade 60.

The body 10 is constructed from a first half 11 and a second half 12 that are abreast combined. Therein, each of the first half 11 and the second half 12 has an end edge formed with an indentation 13, an upper edge formed with a concave portion 14, and a guide 111 provided below the concave portion 14. The guides 111 are parallel to the concave portions 14, and two rows of positioning pits 112 are arranged along the concave portions 14, respectively. The first half 11 further has a lower edge formed with an opened section 113 and a receiving seat 114 deposited therein for intercommunicating with the opened section 113. The second half 12 has a through hole 121 formed at a corner thereof.

The blade holder 20 received in the body 10 is composed of a first plate 21 and a second plate 22 that are abreast combined. The first plate 21 has an engaging portion 211 and the second plate 22 has an engaging portion 221. Each of the engaging portions 211, 221 is slidably coupled with the corresponding guide 111. Therein, the first plate 21 includes a blade socket 212 for accommodating the blade 30. The blade 30 has an outer end mounted with a shield 32 so that a point of the blade 30 is shielded from direct exposure, thereby ensuring safe use. A retaining notch 213 is extended upward from the blade socket 212, while the blade 30 is formed with at least one dent 31 arranged along a sliding direction of the blade holder 20. The dent 31 may be one or more. For allowing the blade 30 to be installed reversely, there are preferably two said dents 31. The second plate 22 is formed with a window 222. A positioning member 23 deposited in the blade socket 212 has a projecting positioning portion 231 facing the blade socket 212. A positioning spring 24 is arranged between the positioning portion 231 and the retaining notch 213. The positioning member 23 also has a projecting abutting portion 232 facing the second plate 22 for being received in the window 222 in the manner that the abutting portion 232 is allowed to slide in the window 222 to and fro with respect to the retaining notch 213. Moreover, the blade holder 20 has a spring socket 25.

The adjusting device 40 is settled in the spring socket 25 while partially exposing outside the concave portions 14. The adjusting device 40 is bilaterally formed with wedge portions 41, each of which is for being wedged into a corresponding said positioning pit 112. An adjusting spring 42 is arranged between the adjusting device 40 and the spring socket 25 for normally pushing the adjusting device 40 upward.

The pivotable spare container 50 is also received in the body 10 near the opened section 113, with one lower corner near the receiving seat 114 pivotally fixed to the body 10. The pivotable spare container 50 includes a blade storing seat 51 for receiving one or more spare blades 60. The pivotable spare container 50 has an engaging notch 52 at a lower part of its lateral. A compressing spring 53 is arranged between the pivotable spare container 50 and the receiving seat 114 for normally pushing the pivotable spare container 50 to pivot outward the opened section 113. A stopper 54 is provided in the first half 11 adjacent to the pivotable spare container 50. The stopper 54 has an engaging node 541 corresponding to the engaging notch 52. A stop spring 55 is received in the stopper 54 for normally pushing the stopper 54 to make the engaging node 541 engaged with the engaging notch 52, so that the pivotable spare container 50 can be positioned at a storage position A, where the pivotable spare container 50 is in the body 10 facing the opened section 113.

Figure 4:
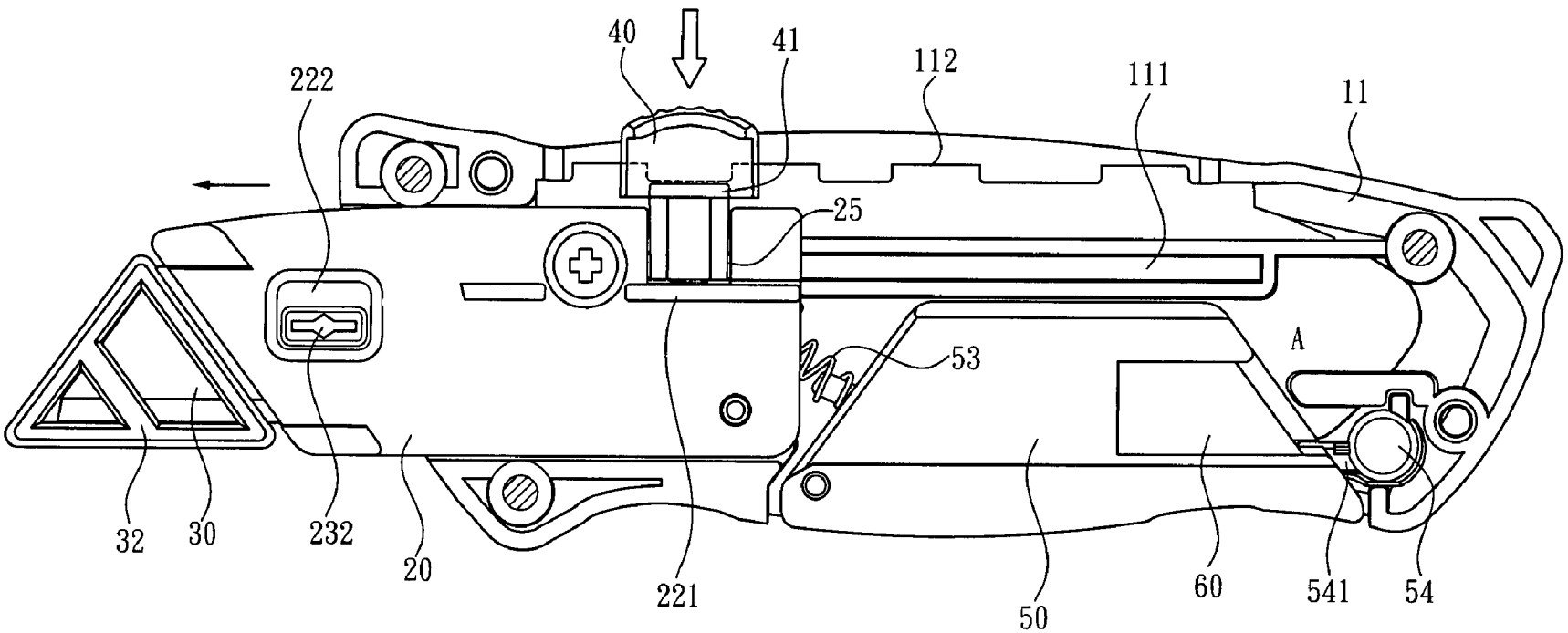
FIGS. 4 and 5 illustrate motions of a blade holder according to the present invention.
Figure 5:
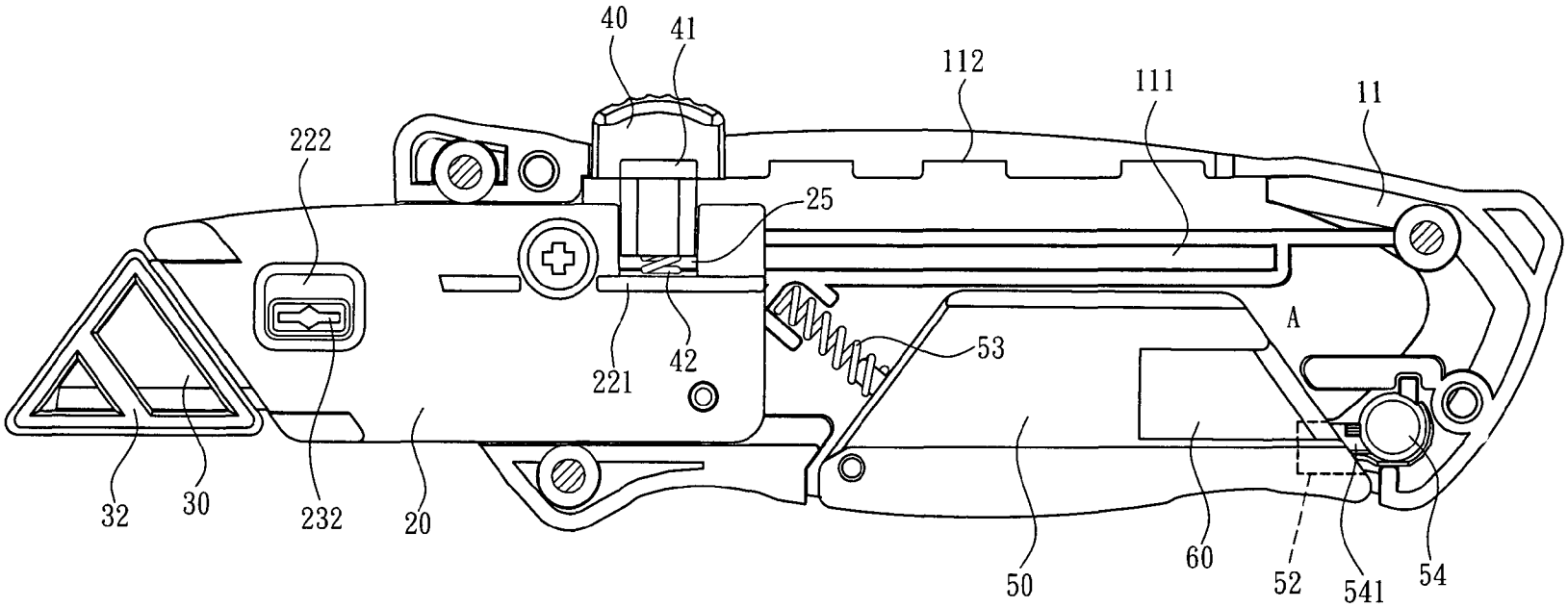

Referring to FIG. 3 through FIG. 5, for using the blade 30 to cut, it is first to press the adjusting device 40, which in turn compresses the adjusting spring 42, so that the wedge portions 41 depart from the positioning pits 112. At this time, the adjusting device 40 can be pushed to slide along the concave portion 14, so the engaging portions 211, 221 slide along the guides 111, for changing an exposed length of the blade holder 20. When the desired exposed length of the blade holder 20 is achieved, the adjusting device 40 can be released, so that the adjusting spring 42 restores and pushes the adjusting device 40 to make the wedge portions 41 engaged with different corresponding positioning pits 112. At this time, the blade holder 20 is firmly positioned. In virtue of the adjusting device 40 and the adjusting spring 42, as well as the positioning pits 112, the blade holder 20 can be stretched in multiple stages. It is impossible to shift the blade holder 20 between the stages unless the adjusting device 40 is pressed downward, thereby ensuring use safety. In other words, the adjusting device 40 is prevented from being unintentionally activated by excessively exerted cutting force so the blade holder 20 is secured from accidentally stretching or retracting, thus protecting the user from being harmed by a broken blade.

Figure 6:
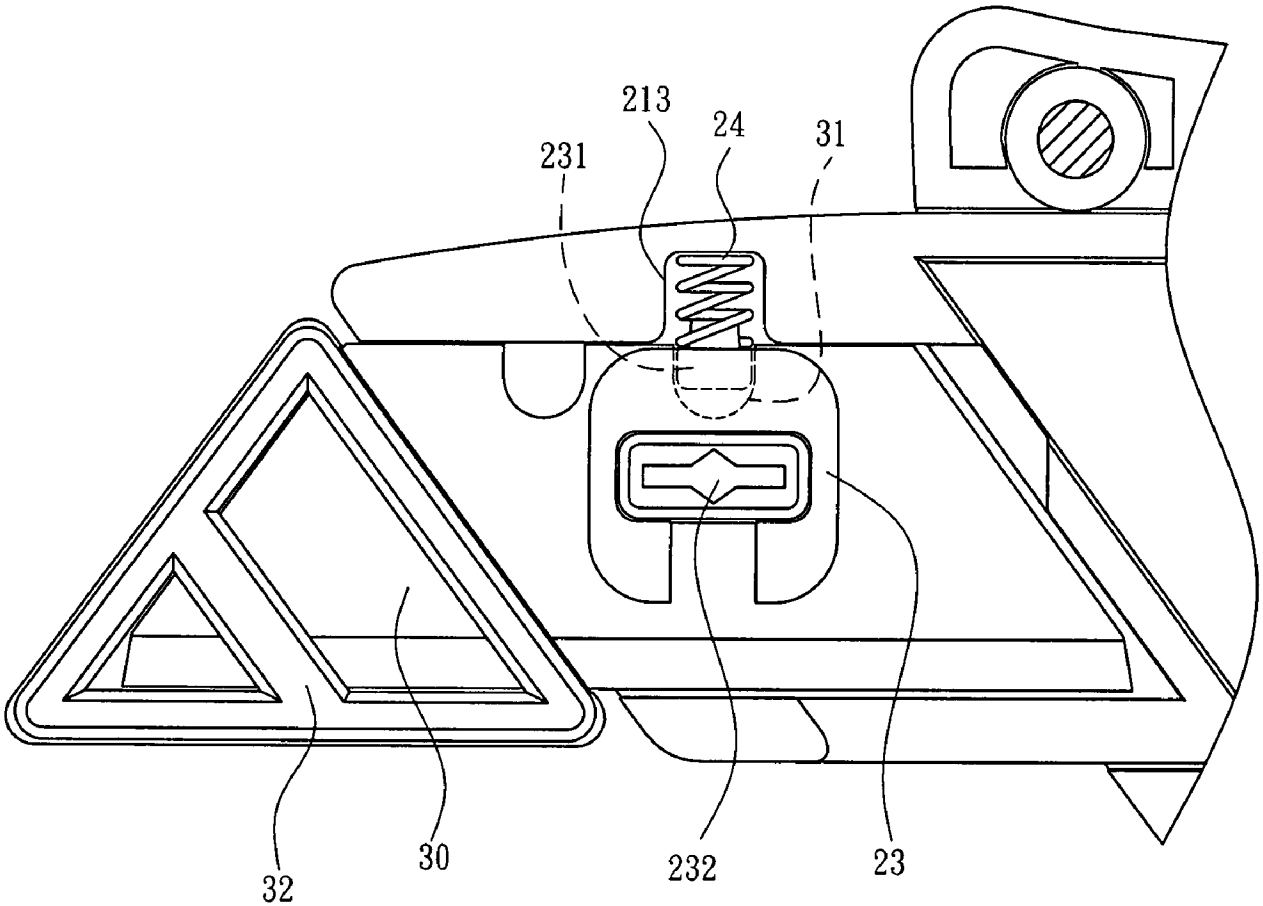
FIG. 6 is a schematic drawing depicting parts of the blade holder and a blade according to the present invention.
Figure 7:
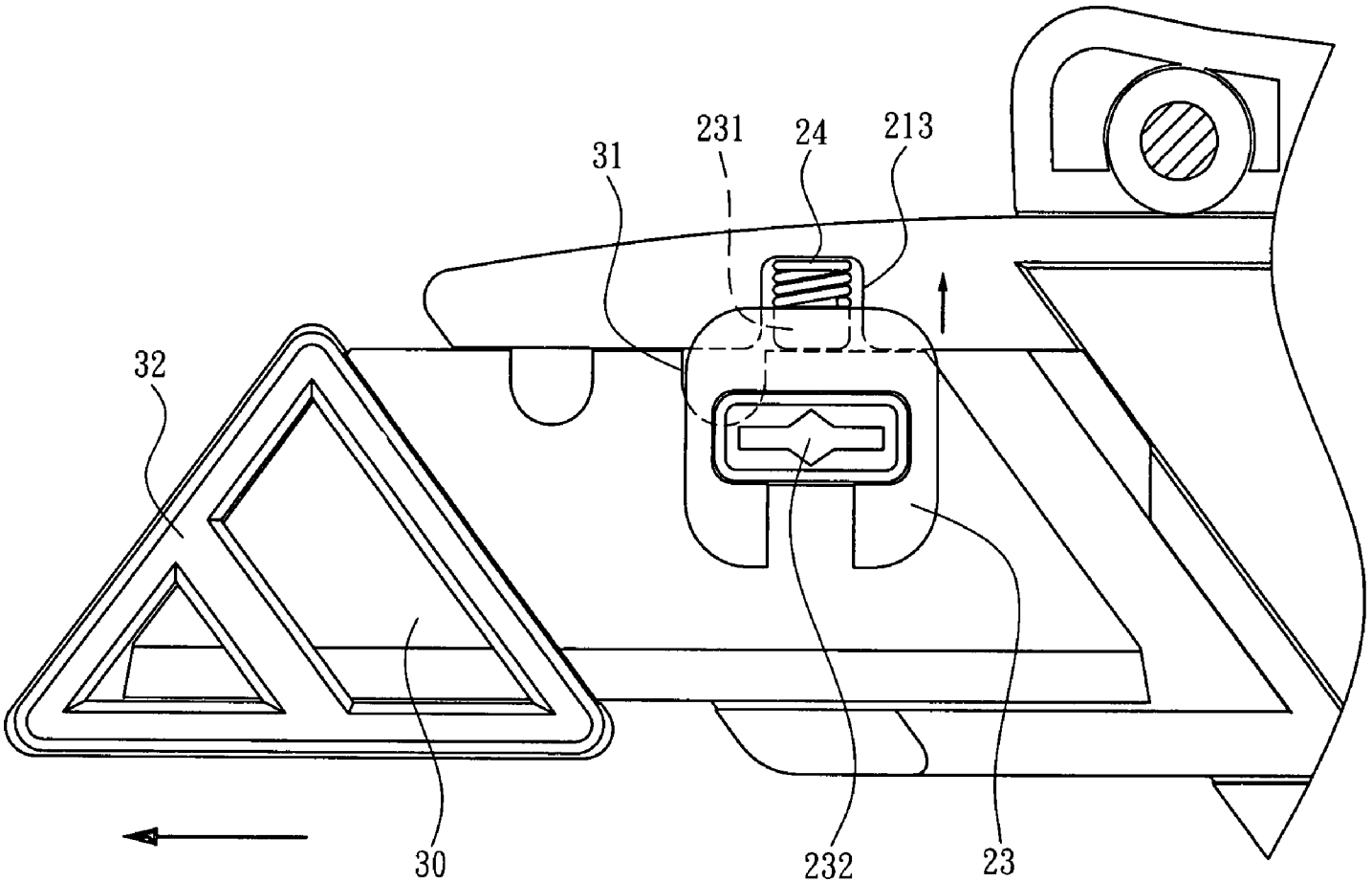
FIG. 7 is a schematic drawing illustrating the blade to be uninstalled according to the present invention.

After a long term of use, the point of the blade 30 is likely to blunt. At this time, the blade 30 can be taken out and reinstalled reversely, so that a new point at the other end of the blade 30 can be used. Alternatively, the blade 30 may be replaced by the spare blade 60. Referring to FIG. 6 and FIG. 7, for uninstalling the blade 30, the abutting portion 232 is pushed upward to compress the positioning spring 24, so the positioning portion 231 departs from the dent 31 and moves toward the retaining notch 213. At this time, the blade 30 can be drawn out for being reinstalled reversely or for reinstalling the spare blade 60. In the case of reinstalling the blade 30 reversely, reinstallation of the blade 30 is finished by aligning the other dent 31 to the positioning portion 231 and the releasing the abutting portion 232, so that the positioning spring 24 restores to push the positioning member 23, in turn making the positioning portion 231 engage the dent 31 for positioning the reinstalled blade 30.

Figure 8:
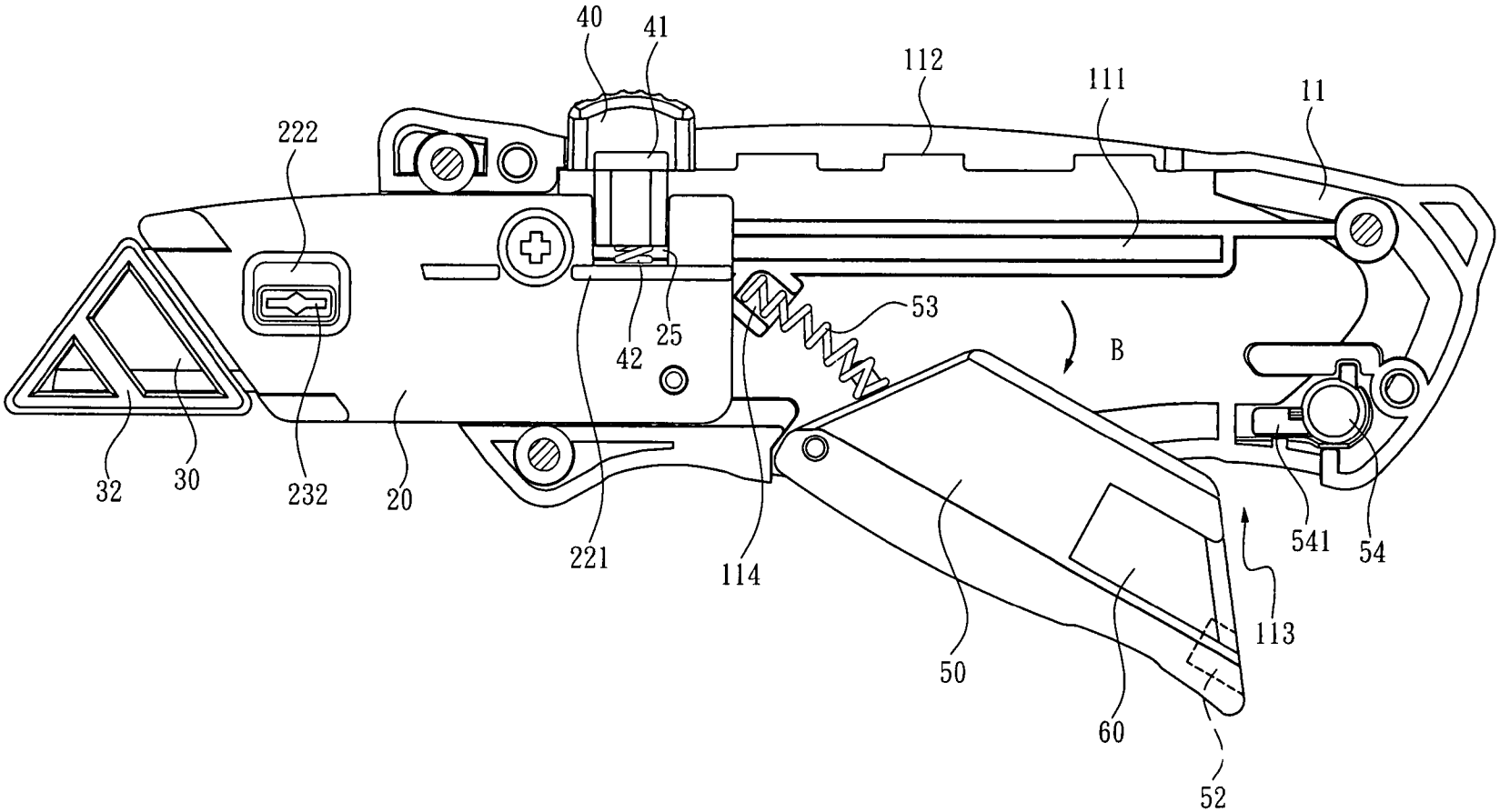
FIG. 8 is a lateral view of the multi-function cutter wherein a pivotable spare container is opened.

Referring to FIG. 5 and FIG. 8, withdrawing the spare blade 60 from the pivotable spare container 50 can be achieved by pressing the stopper 54 to compress the stop spring 55 so that the engaging node 541 departs from the engaging notch 52, then pivoting the pivotable spare container 50 from its storage position A out of the opened section 113 to an access position B where the spare blade 60 can be taken out. After the blade 30 is uninstalled, the withdrawn spare blade 60 can be installed into the blade socket 212 as described above for replacing the blade 30. Then when the pivotable spare container 50 is returned to the storage position A, the stop spring 55 restores and pushes the stopper 54 to make the engaging node 541 engaged with the engaging notch 52, for positioning the pivotable spare container 50 at the storage position A. The blade storing seat 51 may be configured to accommodate plural said spare blades 60, so as to enhance convenience of use.

The present invention has been described with reference to the preferred embodiment and it is understood that the embodiment is not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A multi-function cutter, comprising:

a body composed of a first half and a second half that are abreast combined, wherein each of the first half and the second half has:

an end edge formed with an indentation;

an upper edge formed with a concave portion;

a guide provided below the concave portion; and a row of positioning pits arranged along the concave portion;

a blade holder including:

a blade socket for receiving a blade;

engaging portions bilaterally formed thereon for being slidably coupled with the guides so as to stretch the blade holder outside the indentations, and a spring socket; and an adjusting device being deposited in the spring socket and jutting out of the concave portions, wherein an adjusting spring is arranged between the adjusting device and the spring socket, and the adjusting device is bilaterally formed with wedge portions for detachably engaging corresponding said positioning pits, whereby, when the adjusting device is pressed downward, the adjusting spring is compressed to allow the wedge portions to depart from the positioning pits and the engaging portions are allowed to slide along the guides, and afterward, the adjusting spring that normally pushes the adjusting device makes the wedge portions engage the corresponding positioning pits, so as to allow the blade holder to stretch in multiple stages.

2. The multi-function cutter of claim 1, wherein the first half has a lower edge formed with an opened section and a receiving seat deposited therein for intercommunicating with the opened section, the opened section allowing a pivotable spare container to be received in the first half, and the pivotable spare container having one lower corner near the receiving seat pivotally fixed to the body, so that the pivotable spare container is allowed to pivotally move inward an outward the opened section.

3. The multi-function cutter of claim 2, wherein the pivotable spare container includes a blade storing seat for receiving at least one spare blade.

4. The multi-function cutter of claim 2, wherein a compressing spring is arranged between the pivotable spare container and the receiving seat for normally pushing the pivotable spare container to pivotally move outward the opened section.

5. The multi-function cutter of claim 2, wherein a stopper is provided in the first half adjacent to the pivotable spare container and receives therein a stop spring, while the pivotable spare container has an lower end facing the stopper formed with an engaging notch and the stopper has an engaging node corresponding to the engaging notch, so that when the pivotable spare container pivotally move inward the opened section, the stop spring normally pushes the stopper to make the engaging node engaged with the engaging notch for positioning the pivotable spare container at a storage position, and when the stop spring is compressed, the engaging node is allowed to depart from the engaging notch so that the pivotable spare container automatically pivotally moves out the opened section to arrive at an access position.

6. The multi-function cutter of claim 5, wherein the second half has a through hole for accommodating the stopper.

7. The multi-function cutter of claim 1, wherein the blade holder is composed of a first plate and a second plate that are abreast combined, the blade socket being provided in the first plate and extended upward with a retaining notch, the blade socket including a positioning member, the positioning member having a projecting positioning portion at one lateral, a positioning spring being provided between the positioning portion and the retaining notch, the blade having at least one dent, the positioning spring normally pushing the positioning member to make the positioning portion engaged with the dent so as to position the blade, and when the positioning spring is compressed, the positioning portion departing from the dent for allowing the blade to slide toward the blade socket.

8. The multi-function cutter of claim 7, wherein the positioning member has a projecting abutting portion facing the second plate, and the second plate has a window for receiving the abutting portion, so that the abutting portion is allowed to slide toward the retaining notch in the window.

9. The multi-function cutter of claim 1, wherein the blade has an outer end mounted with a shield.

* * * * *